US007717687B2

(12) United States Patent
Reinhart

(10) Patent No.: US 7,717,687 B2
(45) Date of Patent: May 18, 2010

(54) SCROLL COMPRESSOR WITH COMPLIANT RETAINER

(75) Inventor: Keith J. Reinhart, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 321 days.

(21) Appl. No.: 11/728,331

(22) Filed: Mar. 23, 2007

(65) Prior Publication Data

US 2008/0232990 A1 Sep. 25, 2008

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |

(52) U.S. Cl. ..... 418/55.5; 418/55.1; 418/55.3; 418/57

(58) Field of Classification Search ..... 418/55.1–55.6, 418/57; 464/102

See application file for complete search history.

(56) References Cited

U.S. PATENT DOCUMENTS

| | | | | |
|---|---|---|---|---|
| 3,874,827 | A | | 4/1975 | Young |
| 4,767,293 | A | | 8/1988 | Caillat |
| 4,877,382 | A | | 10/1989 | Caillat |
| 4,895,496 | A | | 1/1990 | Elson |
| 4,992,033 | A | | 2/1991 | Caillat |
| 4,998,864 | A | | 3/1991 | Muir |
| 5,088,906 | A | * | 2/1992 | Richardson, Jr. ..... 418/55.5 |
| 5,102,316 | A | | 4/1992 | Caillat |
| 5,197,868 | A | | 3/1993 | Caillat |
| RE34,297 | E | | 6/1993 | Elson |
| 5,281,114 | A | * | 1/1994 | Bush ..... 418/55.3 |
| 5,295,813 | A | | 3/1994 | Caillat |
| 5,342,184 | A | | 8/1994 | Comparin et al. |
| 5,342,185 | A | | 8/1994 | Anderson |
| 5,368,446 | A | | 11/1994 | Rode |

(Continued)

FOREIGN PATENT DOCUMENTS

| | | |
|---|---|---|
| KR | 10-0196122 | 6/1999 |

OTHER PUBLICATIONS

Written Opinion of the International Searching Authority dated Apr. 23, 2008 regarding International Application No. PCT/US2007/026359.

(Continued)

*Primary Examiner*—Theresa Trieu
(74) *Attorney, Agent, or Firm*—Harness, Dickey & Pierce, P.L.C.

(57) ABSTRACT

A scroll compressor may include a shell, a bearing housing, first and second scroll members, and a ring member. The bearing housing may be supported within the shell and may include at least three axially extending arms. The first scroll member may be supported on the bearing housing and may include a circumferential outer surface. The second scroll member may be supported on the bearing housing and may be meshingly engaged with the first scroll member. The second scroll member may be disposed between the first scroll member and the bearing housing. The ring member may include an open center portion surrounding the circumferential outer surface of the first scroll member therein. A portion of the ring member may be disposed between the arms of the bearing housing and the circumferential outer surface of the first scroll member.

37 Claims, 7 Drawing Sheets

U.S. PATENT DOCUMENTS

| | | | | |
|---|---|---|---|---|
| 5,370,513 | A | | 12/1994 | Fain |
| 5,380,170 | A | | 1/1995 | Fain |
| 5,407,335 | A | | 4/1995 | Caillat |
| 5,411,384 | A | | 5/1995 | Bass |
| 5,580,230 | A | | 12/1996 | Keifer |
| 5,588,819 | A | | 12/1996 | Wallis |
| 5,591,014 | A | | 1/1997 | Wallis |
| 5,607,288 | A | | 3/1997 | Wallis |
| 5,803,716 | A | | 9/1998 | Wallis et al. |
| 5,897,306 | A | | 4/1999 | Beck |
| 5,931,649 | A | | 8/1999 | Caillat |
| 6,027,321 | A | * | 2/2000 | Shim et al. ..... 418/55.5 |
| RE37,019 | E | | 1/2001 | Elson |

OTHER PUBLICATIONS

International Search Report dated Apr. 23, 2008 regarding International Application No. PCT/US2007/026359.

International Preliminary Report on Patentability regarding International Application No. PCT/US2007/026359 dated Sep. 29, 2009.

* cited by examiner

SCROLL COMPRESSOR WITH COMPLIANT RETAINER

FIELD

The present disclosure relates to scroll compressors, and more specifically to scroll retaining devices.

BACKGROUND

The statements in this section merely provide background information related to the present disclosure and may not constitute prior art.

Typically, scroll compressors may include orbiting and non-orbiting scrolls. The non-orbiting scroll may be coupled to a fixed structure of the compressor, such as a main bearing housing. This attachment may be achieved in a variety ways, such as through the use of threaded fasteners. The use of fasteners, however, complicates assembly and promotes the transmission of vibrations from the non-orbiting scroll to the main bearing housing during compressor operation.

SUMMARY

According to the present disclosure, a scroll compressor may include a shell, a housing, a compression mechanism, an Oldham coupling, and a retaining member. The housing may be supported within the shell and may include a support structure therein. The compression mechanism may be supported within the housing and may include first and second scroll members meshingly engaged with one another. The Oldham coupling may be engaged with the first and second scroll members and may prevent relative rotation therebetween. The retaining member may include a radially compliant geometry disposed between the support structure and an outer surface of the first scroll member.

In an alternate arrangement, a scroll compressor may include a shell, a housing, a compression mechanism, and a retaining member. The housing may be supported within the shell and may include a support member therein. The compression mechanism may include first and second scroll members meshingly engaged with one another and supported within the housing. The retaining member may include a ring-like body with an inner surface disposed around an outer surface of the compression mechanism and an outer surface engaged with the support structure. The retaining member may provide a predetermined axial displacement limit for the first scroll member relative to the second scroll member.

Alternatively, a scroll compressor may include a shell, a bearing housing, first and second scroll members, and a ring member. The bearing housing may be supported within the shell and may include at least three axially extending arms. The first scroll member may be supported on the bearing housing and may include a circumferential outer surface. The second scroll member may be supported on the bearing housing and may be meshingly engaged with the first scroll member. The second scroll member may be disposed between the first scroll member and the bearing housing. The ring member may include an open center portion surrounding the circumferential outer surface of the first scroll member. A portion of the ring member may be disposed between the arms of the bearing housing and the circumferential outer surface of the first scroll member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
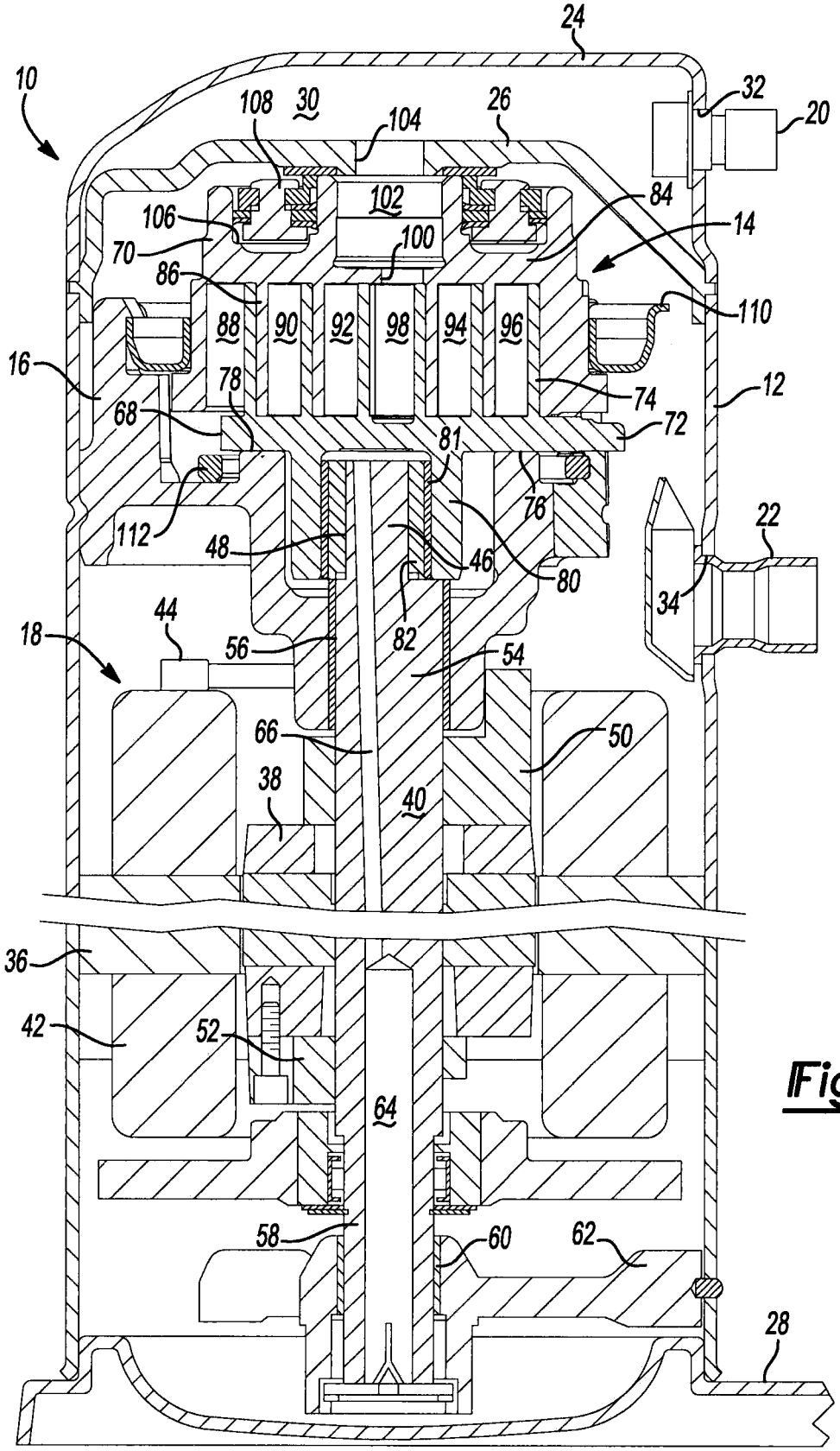
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a cylindrical hermetic shell 12, a compression mechanism 14, a main bearing housing 16, a motor assembly 18, a refrigerant discharge fitting 20, and a suction gas inlet fitting 22. Hermetic shell 12 may house compression mechanism 14, main bearing housing 16, and motor assembly 18. Shell 12 may include an end cap 24 at the upper end thereof, a transversely extending partition 26, and a base 28 at a lower end thereof. End cap 24 and transversely extending partition 26 may generally define a discharge muffler 30. Refrigerant discharge fitting 20 may be attached to shell 12 at opening 32 in end cap 24. Suction gas inlet fitting 22 may be attached to shell 12 at opening 34. Compression mechanism 14 may be driven by motor assembly 18 and supported by main bearing housing 16. Main bearing housing 16 may be affixed to shell 12 at a plurality of points in any desirable manner, such as staking.

Motor assembly 18 may generally include a motor stator 36, a rotor 38, and a drive shaft 40. Motor stator 36 may be press fit into shell 12. Drive shaft 40 may be rotatably driven by rotor 38. Windings 42 may pass through stator 36. Rotor 38 may be press fit on drive shaft 40. A motor protector 44 may be provided in close proximity to windings 42 so that motor protector 44 will de-energize motor assembly 18 if windings 42 exceed their normal temperature range.

Drive shaft 40 may include an eccentric crank pin 46 having a flat 48 thereon and one or more counter-weights 50, 52. Drive shaft 40 may include a first journal portion 54 rotatably journaled in a first bearing 56 in main bearing housing 16 and a second journal portion 58 rotatably journaled in a second bearing 60 in lower bearing housing 62. Drive shaft 40 may include an oil-pumping concentric bore 64 at a lower end. Concentric bore 64 may communicate with a radially outwardly inclined and relatively smaller diameter bore 66 extending to the upper end of drive shaft 40. The lower interior portion of shell 12 may be filled with lubricating oil. Concentric bore 64 may provide pump action in conjunction with bore 66 to distribute lubricating fluid to various portions of compressor 10.

Compression mechanism 14 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with an annular flat thrust bearing surface 78 on an upper surface of main bearing housing 16. A cylindrical hub 80 may project downwardly from thrust surface 76 and may include a journal bearing 81 having a drive bushing 82 rotatively disposed therein. Drive bushing 82 may include an inner bore in which crank pin 46 is drivingly disposed. Crank pin flat 48 may drivingly engage a flat surface in a portion of the inner bore of drive bushing 82 to provide a radially compliant driving arrangement.

Non-orbiting scroll 70 may include an end plate 84 having a spiral wrap 86 on a lower surface thereof. Spiral wrap 86 may form a meshing engagement with wrap 74 of orbiting scroll 68, thereby creating an inlet pocket 88, intermediate pockets 90, 92, 94, 96, and an outlet pocket 98. Non-orbiting scroll 70 may have a centrally disposed discharge passageway 100 in communication with outlet pocket 98 and upwardly open recess 102 which may be in fluid communication with discharge muffler 30 via an opening 104 in partition 26.

Non-orbiting scroll 70 may include an annular recess 106 in the upper surface thereof having parallel coaxial side walls in which an annular floating seal 108 is sealingly disposed for relative axial movement. The bottom of recess 106 may be isolated from the presence of gas under suction and discharge pressure by floating seal 108 so that it can be placed in fluid communication with a source of intermediate fluid pressure by means of a passageway (not shown). The passageway may extend into an intermediate pocket 90, 92, 94, 96. Non-orbiting scroll 70 may therefore be axially biased against orbiting scroll 68 by the forces created by discharge pressure acting on the central portion of non-orbiting scroll 70 and those created by intermediate fluid pressure acting on the bottom of recess 106. Retaining member 110 may secure non-orbiting scroll 70 to main bearing housing 16 for limited axial movement therebetween, as discussed below. Relative rotation of orbiting and non-orbiting scrolls 68, 70 may be prevented by an Oldham coupling 112, as discussed below.

Figure 2:
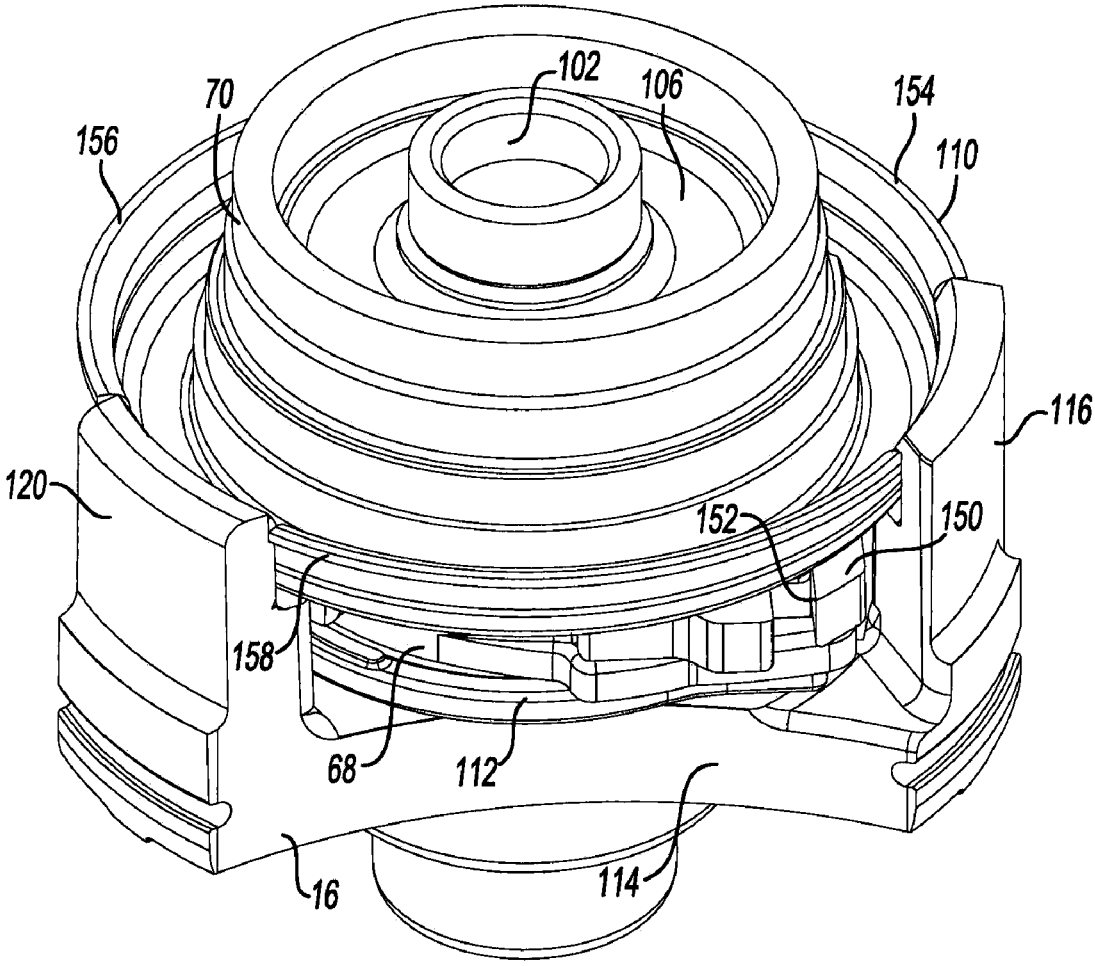
FIG. 2 is a perspective view of the compression mechanism shown in FIG. 1 having a first retaining assembly.
Figure 3:
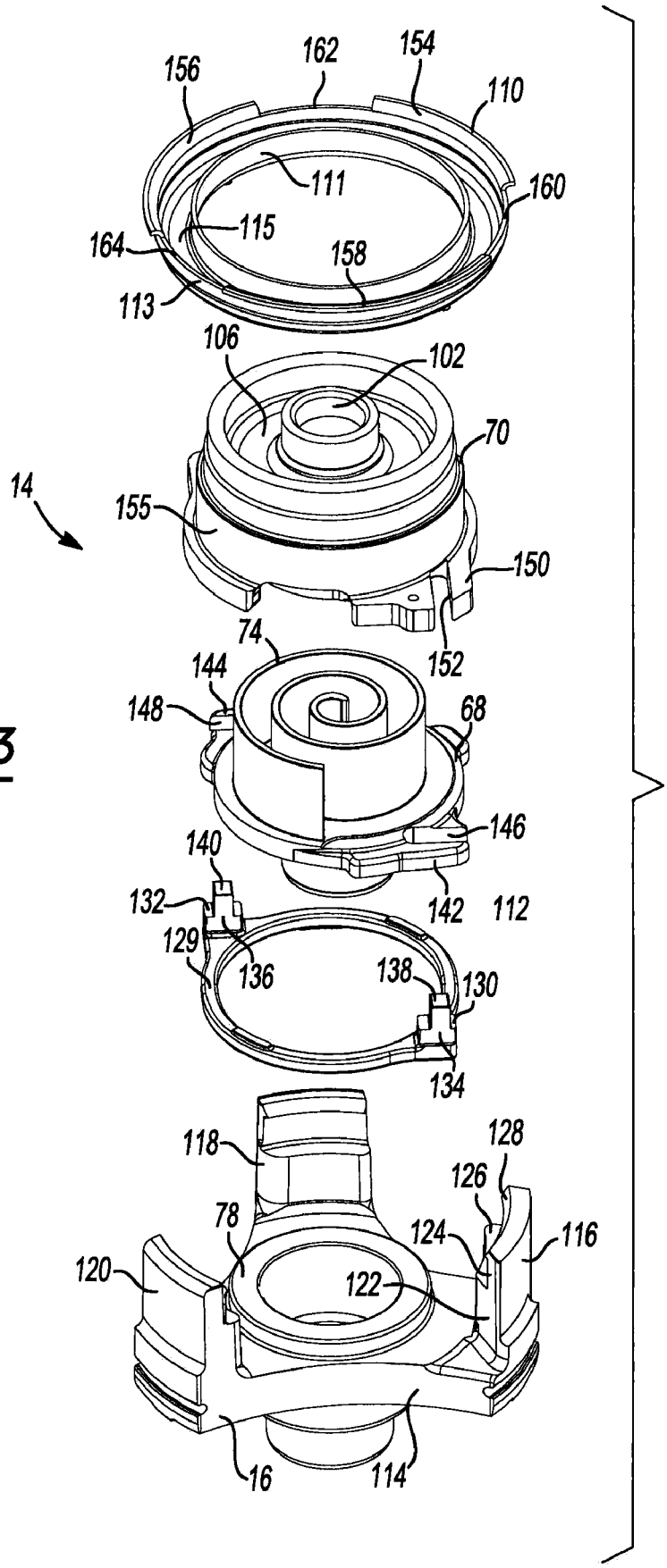
FIG. 3 is a perspective exploded view of the compression mechanism and retaining assembly of FIG. 2.

With reference to FIGS. 2 and 3, main bearing housing 16 may include a radially extending body portion 114 having three arms 116, 118, 120 extending axially upwardly therefrom. More specifically, arms 116, 118, 120 may extend axially upwardly to a location at least at a midpoint of one of wraps 74, 86. Each of arms 116, 118, 120 may be generally similar to one another. Therefore, arm 116 will be discussed with the understanding that the description applies equally to arms 118, 120. Arm 116 may include first and second portions 122, 124 having first and second inner diameters. First portion 122 may be disposed between second portion 124 and body portion 114. First portion 122 may have an inner diameter that is greater than the inner diameter of second portion 124, forming a step 126 therebetween. A lip 128 may be located at an axially outer end of arm 116 and may have an inner diameter that is less than the inner diameter of second portion 124.

Oldham coupling 112 may be a two-up stacked Oldham including a ring 129 and first and second keys 130, 132. Keys 130, 132 may each include first portions 134, 136 and second portions 138, 140. Oldham coupling 112 may be disposed on and abut body portion 114. The outer diameter of ring 129 may be generally similar to the inner diameter of first portion 122, locating Oldham coupling 112 within arms 116, 118, 120. Orbiting scroll 68 may abut thrust surface 76 and may be disposed adjacent Oldham coupling 112. Orbiting scroll 68 may include flanges 142, 144 having slots 146, 148 slidably engaged with first portions 134, 136 of keys 130, 132. Non-orbiting scroll 70 may be meshingly engaged with orbiting scroll 68 and may include flanges (only one of which is shown) 150 having slots 152 slidably engaged with second portions 138, 140 of keys 130, 132. Retaining member 110 may be disposed around an outer surface 155 of non-orbiting scroll 70 and may secure orbiting scroll 68, non-orbiting scroll 70, and Oldham coupling 112 to main bearing housing 16.

More specifically, retaining member 110 may secure orbiting scroll 68, non-orbiting scroll 70, and Oldham coupling 112 to main bearing housing 16 without the use of any fasteners. Retaining member 110 may include a generally circular body having an upwardly extending U-shaped cross-section having upwardly extending inner and outer legs 111, 113 and a transversely extending base 115. Retaining member 110 may have a series of radially outwardly extending flanged portions 154, 156, 158 at an upper end thereof, forming a series of recesses 160, 162, 164 therebetween. Recesses 160, 162, 164 may generally correspond to arms 116, 118, 120. Retaining member 110 may be retained within second portion 124 of arms 116, 118, 120.

The outer diameter of retaining member 110 may be less than the inner diameter of arm second portion 124 and greater than the inner diameter of arm first portion 122 and lip 128, axially securing retaining member 110, and therefore orbiting scroll 68, non-orbiting scroll 70, and Oldham coupling 112, to main bearing housing 16. More specifically, retaining member 110 may be captured between step 126 and lip 128. Alternatively, retaining member 110 may be captured between step 126 and partition 26. A clearance may be provided for axial displacement of non-orbiting scroll 70 relative to main bearing housing 16. The clearance may be located between an upper surface of flange 150 of non-orbiting scroll 70 and a lower surface of base 115 of retaining member 110. Alternatively, the distance between step 126 and lip 128 may be greater than the height of retaining member 110. The outer diameter of retaining member 110 may be less than the inner diameter of arm second portion 124, providing for axial displacement of retaining member 110 between step 126 and lip 128.

Flanged portions 154, 156, 158 may have an outer diameter greater than the inner diameter of arm second portion 124, rotationally securing retaining member 110 to main bearing housing 16. The lower surface of base 115 of retaining member 110 may further include protrusions 166, 168 (shown in FIG. 4) extending therefrom and into slots 152 in non-orbiting scroll 70, rotationally securing non-orbiting scroll 70 to retaining member 110, and therefore main bearing housing 16. The U-shaped cross-section of retaining member 110 may provide for collection of returning oil. Apertures 170 may be located through base 115 and protrusions 166, 168 of retaining member 110 (shown in FIG. 4) to allow oil to lubricate keys 130, 132 of Oldham coupling 112.

The U-shaped retaining member 110 may be formed from a stamping. The U-shaped construction may generally allow for deflection of retaining member 110 during insertion into main bearing housing 16. More specifically, outer leg 113 may deflect during insertion without distorting the roundness of the inner diameter of inner leg 111. While retaining member 110 is shown secured to main bearing housing 16 through a snap-fit arrangement, it is understood that an interference fit engagement could be used as well, providing a predetermined axial clearance between non-orbiting scroll 70 and retaining member 110 for axial displacement of non-orbiting scroll 70 relative to retaining member 110 and main bearing housing 16 during compressor operation. When an interference fit engagement is used to couple retaining member 110 to main bearing housing 16, retaining member 110 may have an uninstalled outer diameter that is greater than the inner diameter of arm second portion 124. In either securing method, there is a mechanical engagement between retaining member 110 and main bearing housing 16, eliminating the need for a fastener. Retaining member 110 may also provide for alignment of non-orbiting scroll 70.

More specifically, the inner diameter of retaining member 110 may serve as a guide cylinder for outer surface 155 of non-orbiting scroll 70. The U-shaped cross-section may absorb and dampen the forces applied by compression mechanism 14 to main bearing housing 16, and therefore shell 12, as a result of the elastic properties of retaining member 110.

During assembly, Oldham coupling 112, orbiting scroll 68, and non-orbiting scroll 70 may be placed in main bearing housing 16 as described above. Retaining member 110 may then be snap-fit or interference fit to second portion 124 of arms 116, 118, 120 of main bearing housing 16, axially retaining Oldham coupling 112, orbiting scroll 68, and non-orbiting scroll 70 between body portion 114 of main bearing housing 16 and retaining member 110. More specifically, recesses 160, 162, 164 may be aligned with arms 116, 118, 120 before fitting retaining member 110 within arms 116, 118, 120. Oldham coupling 112, orbiting scroll 68, and non-orbiting scroll 70 may be radially retained within arms 116, 118, 120 of main bearing housing 16.

Figure 4:
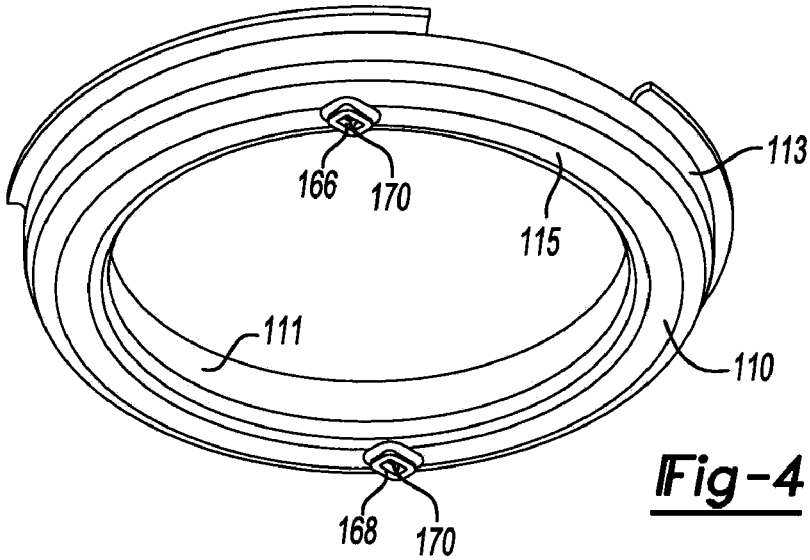
FIG. 4 is a perspective view of a portion of the retaining assembly shown in FIG. 2.
Figure 5:
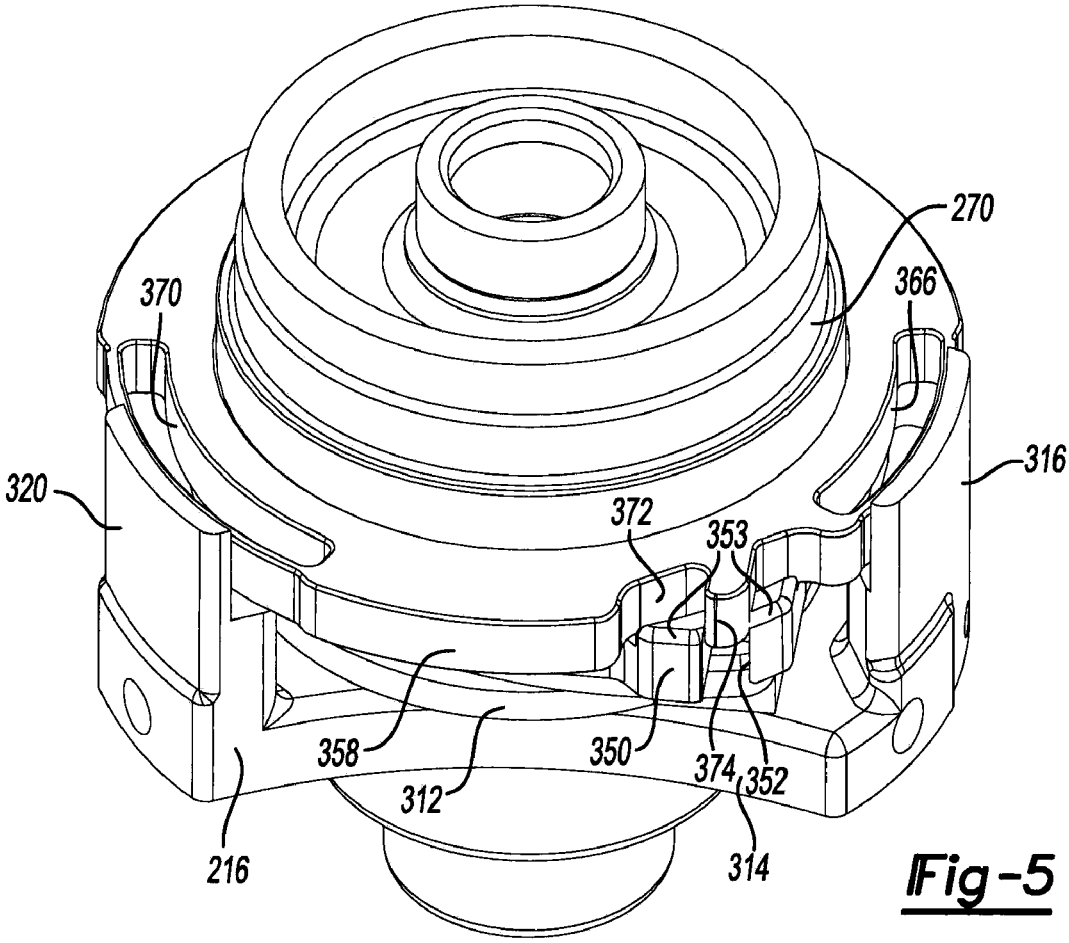
FIG. 5 is a perspective view of a compression mechanism having a second retaining assembly.
Figure 6:
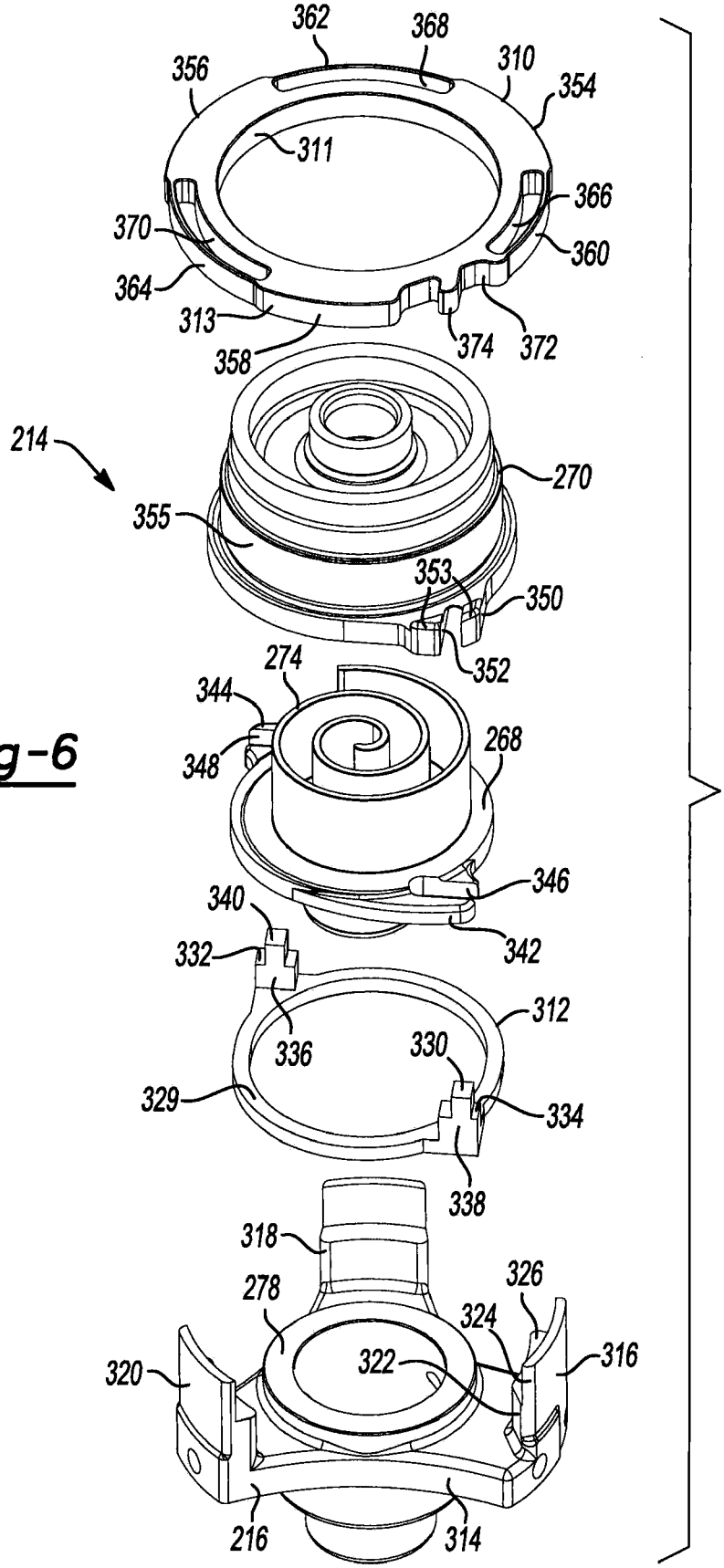
FIG. 6 is a perspective exploded view of the compression mechanism and retaining assembly of FIG. 5.

An alternate main bearing housing 216, Oldham coupling 312, orbiting scroll 268, non-orbiting scroll 270, and retaining member 310 are shown in FIGS. 5 and 6 and may be generally similar to those shown in FIGS. 3 and 4. Main bearing housing 216 may include a radially extending body portion 314 having three arms 316, 318, 320 extending axially upwardly therefrom. More specifically, arms 316, 318, 320 may extend axially upwardly to a location at least at a midpoint of one of the wraps of orbiting and non-orbiting scrolls 268, 270. Each of arms 316, 318, 320 may be generally similar to one another. Therefore, arm 316 will be discussed with the understanding that the description applies equally to arms 318, 320. Arm 316 may include first and second portions 322, 324 having first and second inner diameters. First portion 322 may be disposed between second portion 324 and body portion 314. First portion 322 may have an inner diameter that is greater than the inner diameter of second portion 324, forming a step 326 therebetween.

Oldham coupling 312 may include a ring 329 and first and second keys 330, 332. Keys 330, 332 may each include first portions 334, 336 and second portions 338, 340. Oldham coupling 312 may be disposed on and abut body portion 314. The outer diameter of ring 329 may be generally similar to the inner diameter of first portion 322, locating Oldham coupling 312 within arms 316, 318, 320. Orbiting scroll 268 may abut thrust surface 278 and may be disposed adjacent Oldham coupling 312. Orbiting scroll 268 may include flanges 342, 344 having slots 346, 348 slidably engaged with first portions 334, 336 of keys 330, 332. Non-orbiting scroll 270 may be meshingly engaged with orbiting scroll 268 and may include flanges (only one of which is shown) 350 having slots 352 slidably engaged with second portions 338, 340 of keys 330, 332. Ends of flanges 350 on opposite sides of slots 352 may include upwardly extending protrusions 353. Retaining member 310 may be disposed around an outer surface 355 of non-orbiting scroll 270 and may secure orbiting scroll 268, non-orbiting scroll 270, and Oldham coupling 312 to main bearing housing 216.

More specifically, retaining member 310 may secure orbiting scroll 268, non-orbiting scroll 270, and Oldham coupling 312 to main bearing housing 216 without the use of any fasteners. Retaining member 310 may include a generally circular body having inner and outer diameter portions 311, 313. Three recessed portions 360, 362, 364 may be located in outer diameter portion 313 and may generally correspond to arms 316, 318, 320 of main bearing housing 216. Arcuate apertures 366, 368, 370 may extend axially through upper and lower surfaces of retaining member 310. Apertures 366, 368, 370 may be located between inner and outer diameter portions 311, 313 at recessed portions 360, 362, 364. First, second, and third portions 354, 356, 358 of retaining member 310 may be disposed between recessed portions 360, 362, 364 and may extend radially outwardly relative thereto. An additional recessed portion 372 may be located in third portion 358 and may have an arm 374 extending radially outwardly therefrom and located between protrusions 353 in non-orbiting scroll 270. Locating arm 374 between protrusions 353 may prevent rotation of non-orbiting scroll 270 relative to retaining member 310.

Recessed portions 360, 362, 364 may have an uninstalled outer diameter that is greater than the inner diameter of arm second portion 324. When installed, recessed portions 360, 362, 364 may abut the radially inner surface of arm second portion 324 and may be deformed to have an outer diameter generally similar to arm second portion 324 creating an interference fit therebetween, axially fixing retaining member 310 to main bearing housing 216 without the use of any fasteners. First, second, and third portions 354, 356, 358 of retaining member 310 may have an outer diameter greater than the outer diameter of recessed portions 360, 362, 364 both before and after installation into main bearing housing 216. As such, first, second, and third portions 354, 356, 358 have an outer diameter greater than the inner diameter of arm second portion 324, preventing rotation of retaining member 310 relative to main bearing housing 216.

A clearance may be provided for axial displacement of non-orbiting scroll 270 relative to main bearing housing 216. The clearance may be located between an upper surface of flange 350 of non-orbiting scroll 270 and a lower surface of retaining member 310. The engagement between arm 374 of retaining member 310 and protrusions 353 of non-orbiting scroll 270 may prevent relative rotation between non-orbiting scroll 270 and main bearing housing 216.

Apertures 366, 368, 370 may generally allow for deflection of retaining member 310 during insertion into main bearing housing 216. More specifically, outer diameter portion 313 may deflect at recessed portions 360, 362, 364 during insertion without distorting the roundness of inner diameter portion 311. As indicated above, there is a mechanical engagement between retaining member 310 and main bearing housing 216, eliminating the need for a fastener. Retaining member 310 may also provide for alignment of non-orbiting scroll 270.

More specifically, the inner diameter of retaining member 310 may serve as a guide cylinder for outer surface 355 of non-orbiting scroll 270. Apertures 366, 368, 370 may provide compliance in retaining member 310 at recessed portions 360, 362, 364, which may therefore absorb and dampen the forces applied by compression mechanism 214 to main bearing housing 216.

During assembly, Oldham coupling 312, orbiting scroll 268, and non-orbiting scroll 270 may be placed in main bearing housing 216 as described above. Retaining member 310 may then be press fit (or interference fit) onto second portion 324 of arms 316, 318, 320 of main bearing housing 216, axially retaining Oldham coupling 312, orbiting scroll 268, and non-orbiting scroll 270 between body portion 314 of main bearing housing 216 and retaining member 310. More specifically, recessed portions 360, 362, 364 may be aligned with arms 316, 318, 320 before fitting retaining member 310 within arms 316, 318, 320. Oldham coupling 312, orbiting scroll 268, and non-orbiting scroll 270 may be radially retained within arms 316, 318, 320 of main bearing housing 216.

Figure 7:
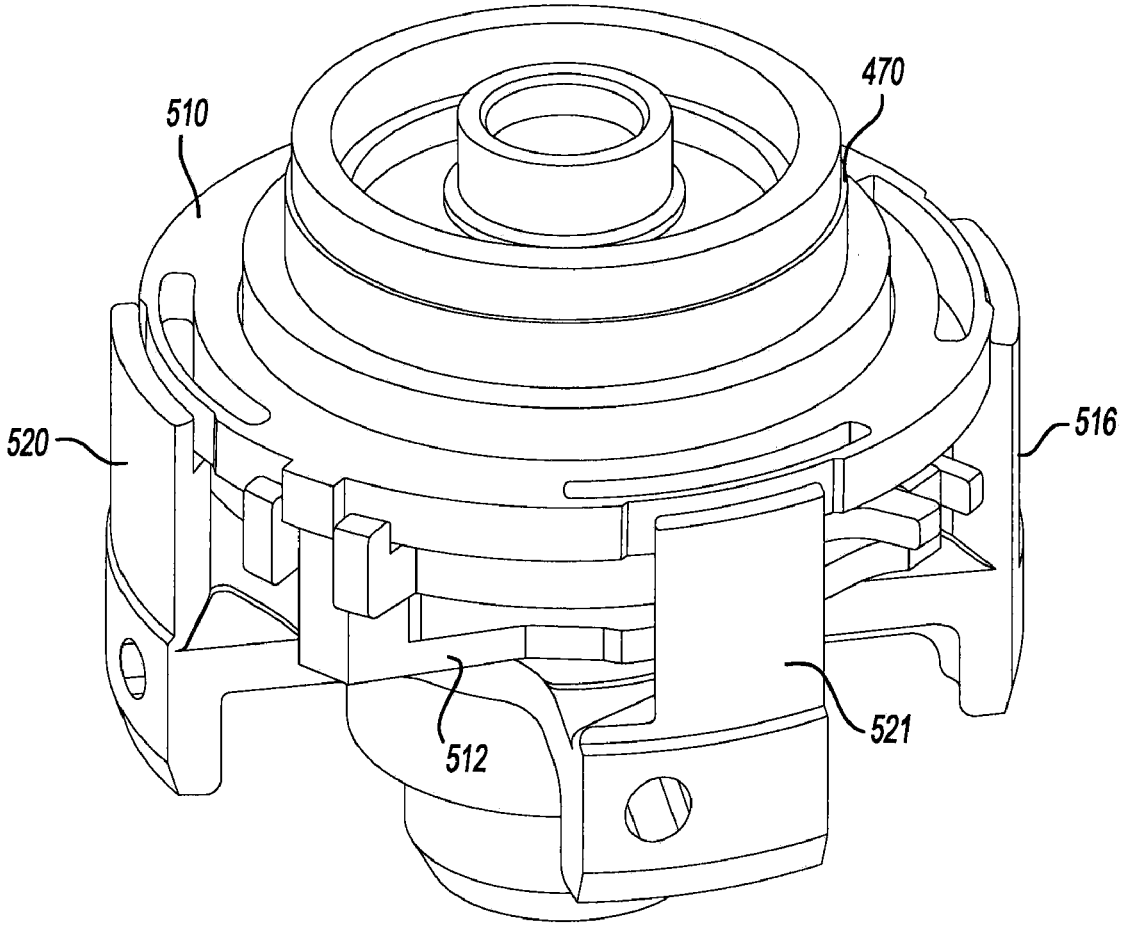
FIG. 7 is a perspective view of a compression mechanism having a third retaining assembly.
Figure 8:
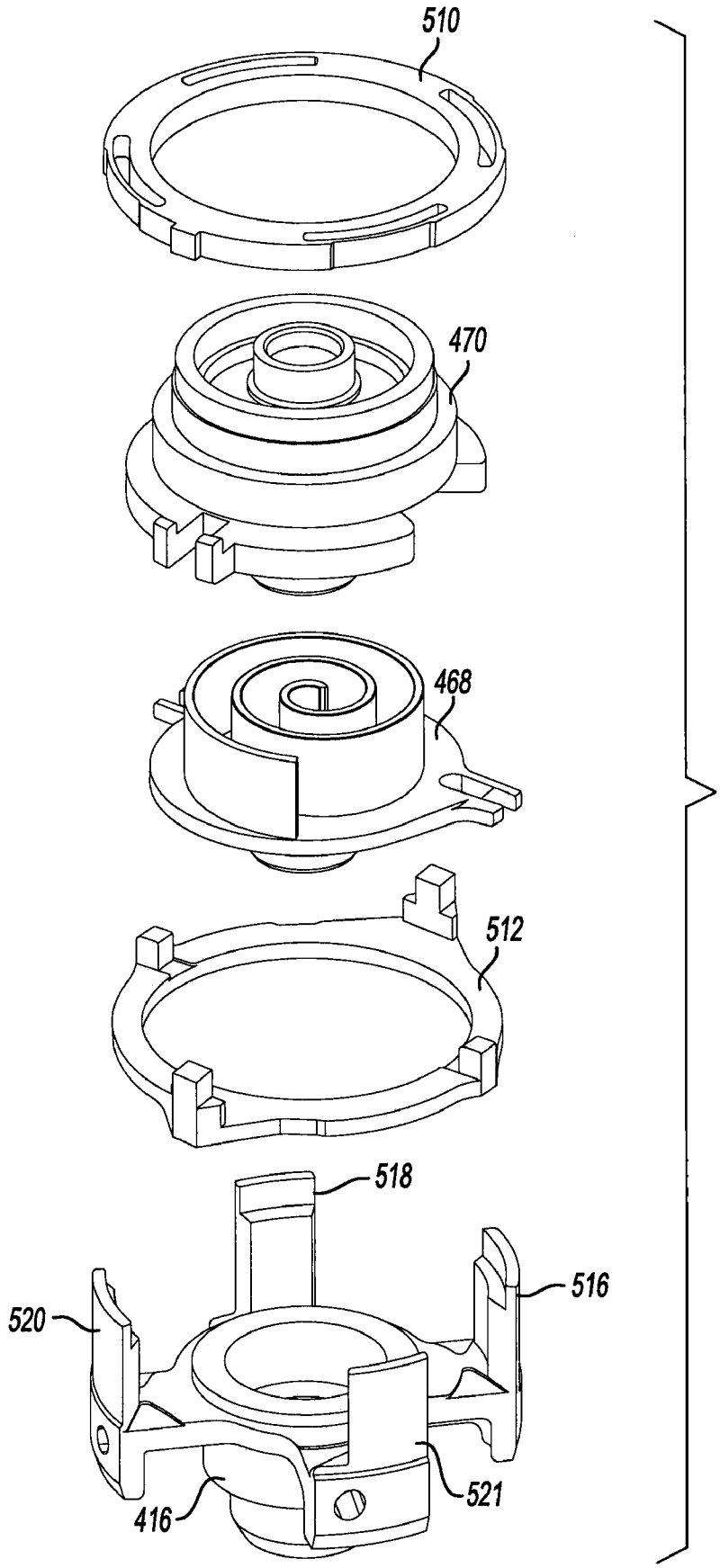
FIG. 8 is a perspective exploded view of the compression mechanism and retaining assembly of FIG. 7.

An alternate main bearing housing 416, Oldham coupling 512, orbiting scroll 468, non-orbiting scroll 470, and retaining member 510 are shown in FIGS. 7 and 8 and may be generally similar to those shown in FIGS. 5 and 6. However, Oldham coupling 512 is shown as a conventional four-up Oldham and main bearing housing 416 is shown having four arms 516, 518, 520, 521. Therefore, for simplicity, main bearing housing 416, Oldham coupling 512, orbiting scroll 468, non-orbiting scroll 470, and retaining member 510 will not be described in detail with the understanding that the majority of the description regarding FIGS. 5 and 6 applies equally to FIGS. 7 and 8.

Figure 9:
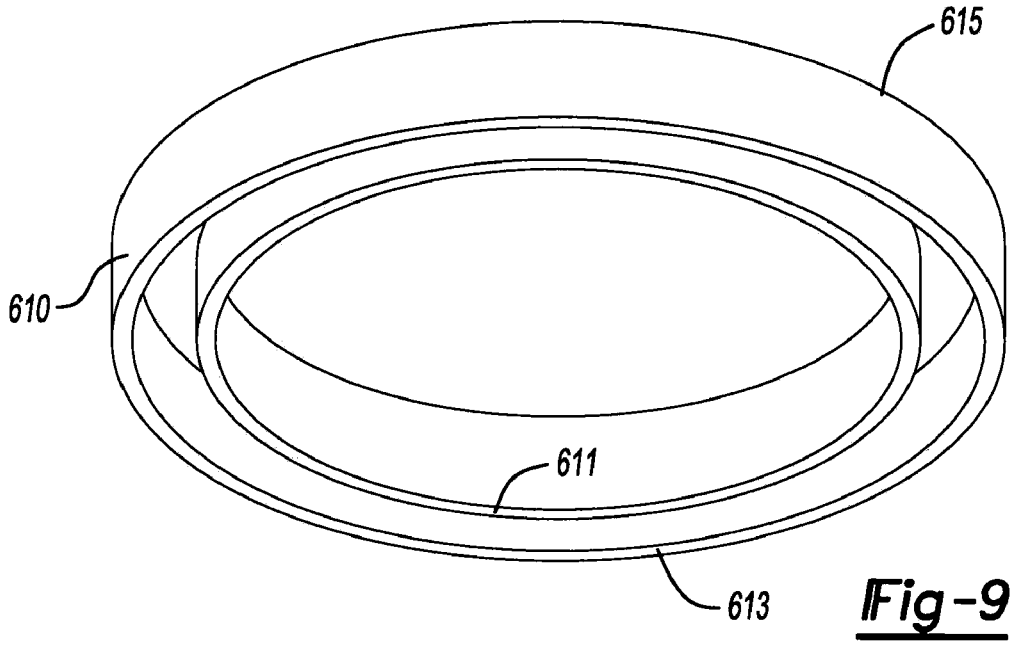
FIG. 9 is a perspective view of a portion of a fourth retaining assembly.

An alternate retaining member 610 is shown in FIG. 9. Retaining member 610 may be used in any of the arrangements shown and may be generally similar to retaining member 110, but oriented in the opposite direction. Retaining member 610 may include a generally circular body having a downwardly extending U-shaped cross-section having downwardly extending inner and outer legs 611, 613 and a transversely extending base 615. Legs 611, 613 may allow for deflection for both installation and dampening as discussed above regarding retaining member 110.

What is claimed is:

1. A scroll compressor comprising:

a shell;

a housing supported within said shell and including a support structure therein;

a compression mechanism supported within said housing and including first and second scroll members meshingly engaged with one another;

an Oldham coupling engaged with said first and second scroll members and preventing relative rotation therebetween;

and a retaining member including a ring disposed radially between an inner surface of said support structure and an outer surface of said first scroll member, said retaining member including a radially compliant structure disposed between said inner surface of said support structure and said outer surface of said first scroll member.

2. The compressor of claim 1, wherein said retaining member includes a radially inner surface surrounding a portion of said outer surface of said first scroll member, said radially inner surface of said retaining member and said outer surface of said first scroll member having a clearance therebetween.

3. The compressor of claim 1, wherein said retaining member is coupled to said housing for a fixed amount of axial displacement therebetween.

4. The compressor of claim 3, wherein said first scroll member includes a flange portion extending radially outwardly therefrom, said flange portion disposed between said retaining member and said second scroll member and extending radially outwardly relative to a portion of said retaining member, capturing said first scroll member axially between said retaining member and said second scroll member.

5. The compressor of claim 1, wherein said retaining member is axially fixed relative to said housing.

6. The compressor of claim 1, wherein said radially compliant structure includes a U-shaped cross-section having first and second legs being displaceable relative to one another.

7. The compressor of claim 6, wherein said radially compliant structure includes an oil collection region having said U-shaped cross-section, said oil collection region including an aperture to provide oil flow to a desired location.

8. The compressor of claim 7, wherein said desired location includes a location where said Oldham coupling is engaged with said first and second scroll members.

9. The compressor of claim 1, wherein said retaining member includes a generally solid body portion, said radially compliant structure including an aperture extending axially through said generally solid body portion adjacent said support structure.

10. The compressor of claim 1, wherein said housing includes a main bearing housing.

11. The compressor of claim 1, wherein said support structure includes first and second axially extending arms having said retaining member engaged therewith.

12. The compressor of claim 11, wherein said first and second axially extending arms extend to a location at least at a midpoint of a wrap height of said first and second scroll members.

13. A scroll compressor comprising:

a shell;

a housing supported within said shell and including a support member therein;

a compression mechanism including first and second scroll members meshingly engaged with one another and supported within said housing; and a retaining member having a ring-like body with an inner surface disposed around an outer surface of said compression mechanism and an outer surface engaged with said support structure, said retaining member providing a predetermined axial displacement limit for said first scroll member relative to said second scroll member.

14. The compressor of claim 13, wherein said retaining member is coupled to said housing for a fixed amount of axial displacement therebetween.

15. The compressor of claim 14, wherein said first scroll member includes a flange portion extending radially outwardly therefrom, said flange portion disposed between said retaining member and said second scroll member and extending radially outwardly relative to a portion of said retaining member, capturing said first scroll member axially between said retaining member and said second scroll member.

16. The compressor of claim 13, wherein said retaining member is axially fixed relative to said housing.

17. The compressor of claim 13, wherein said retaining member includes a radially compliant structure including a U-shaped cross-section having first and second legs being displaceable relative to one another.

18. The compressor of claim 17, wherein said radially compliant structure includes an oil collection region having said U-shaped cross-section, said oil collection region including an aperture to provide oil flow to a desired location.

19. The compressor of claim 18, wherein said desired location includes a location where said first and second scroll members are engaged with an Oldham coupling.

20. The compressor of claim 13, wherein said retaining member includes a generally solid body portion and a radially compliant structure including an aperture extending axially through said generally solid body portion adjacent said support structure.

21. The compressor of claim 13, wherein said housing includes a main bearing housing.

22. The compressor of claim 13, wherein said support structure includes first and second axially extending arms having said retaining member engaged therewith.

23. The compressor of claim 22, wherein said first and second axially extending arms extend to a location at least at a midpoint of a wrap height of said first and second scroll members.

24. A scroll compressor comprising:

a shell;

a bearing housing supported within said shell and including at least three axially extending arms;

a first scroll member supported within said bearing housing and including a first end plate having a first spiral wrap provided on one side thereof and a circumferential outer surface;

a second scroll member supported within said bearing housing and including a second end plate and a second spiral wrap provided on one side thereof and meshingly engaged with said first spiral wrap, said second scroll member disposed between said first scroll member and said bearing housing; and a ring member including an open center portion surrounding said circumferential outer surface of said first scroll member, at least a portion of said ring member disposed between said arms of said bearing housing and said circumferential outer surface of said first scroll member.

25. The compressor of claim 24, further comprising a clearance between said open center portion of said ring member and said circumferential outer surface of said first scroll member, said first scroll member being axially displaceable relative to said second scroll member.

26. The compressor of claim 24, wherein said ring member includes a structure configured to reduce vibration transmission when said first scroll member contacts said ring member during compressor operation.

27. The compressor of claim 26, wherein said ring member includes a recess located radially between one of said arms and said open center portion.

28. The compressor of claim 24, wherein said ring member includes a U-shaped cross-section.

29. The compressor of claim 28, wherein said U-shaped cross-section opens axially outwardly relative to said radially extending surface of said bearing housing.

30. The compressor of claim 28, wherein said ring member includes an oil collection region having said U-shaped cross-section, said oil collection region including an aperture to provide oil flow to a desired location.

31. The compressor of claim 28, wherein said desired location includes a location where said first and second scroll members are engaged with an Oldham coupling.

32. The compressor of claim 24, wherein said axially extending arms extend to a location at least at a midpoint of a height of one of said first and second spiral wraps.

33. A method of assembling a scroll compressor, comprising:

placing first and second scroll members within a bearing housing of a scroll compressor;

locating a retaining ring including a radially compliant structure around an outer surface of the first scroll member; and securing the retaining ring to the bearing housing radially between the outer surface of the first scroll member and an inner surface of the bearing housing to provide limited axial movement between the first scroll member and the bearing housing.

34. The method of claim 33, wherein said securing includes providing a snap-fit engagement between the retaining ring and the bearing housing.

35. The method of claim 33, wherein said securing includes providing an interference-fit engagement between the retaining ring and the bearing housing.

36. The method of claim 33, wherein said securing includes coupling the retaining ring to the bearing housing for axial displacement therebetween.

37. The method of claim 33, wherein said locating includes positioning the retaining ring a predetermined distance axially outwardly relative to a radially outwardly extending portion of the first scroll member.

* * * * *